US006669605B2

(12) United States Patent
Scates

(10) Patent No.: US 6,669,605 B2
(45) Date of Patent: Dec. 30, 2003

(54) VARIABLE PATH INFANT WALKER

(76) Inventor: Charlene Scates, 1105 South Divinity St., Philadelphia, PA (US) 19143

( * ) Notice: Subject to any disclaimer, the term of this patent is extended or adjusted under 35 U.S.C. 154(b) by 219 days.

(21) Appl. No.: 09/880,524

(22) Filed: Jun. 13, 2001

(65) Prior Publication Data

US 2002/0193209 A1 Dec. 19, 2002

(51) Int. Cl.[7] ..... A61H 3/00
(52) U.S. Cl. ..... 482/69; 602/36
(58) Field of Search ..... 482/69, 66; 212/336; 104/140, 141, 138.1, 112

(56) References Cited

U.S. PATENT DOCUMENTS

| | | | | | |
|---|---|---|---|---|---|
| 58,510 | A | | 10/1866 | Thompson | |
| 429,004 | A | * | 5/1890 | Bierbach | 104/140 |
| 432,054 | A | * | 7/1890 | Lamplugh | 104/141 |
| 1,297,800 | A | | 3/1919 | Cranford | |
| 2,478,004 | A | | 8/1949 | Newell | |
| 3,722,883 | A | | 3/1973 | O'Dowd | |
| 4,844,452 | A | | 7/1989 | Tomosky et al. | |
| 6,079,578 | A | * | 6/2000 | Dyson | 212/336 |

* cited by examiner

*Primary Examiner*—Stephen R. Crow
(74) *Attorney, Agent, or Firm*—Volpe and Koenig, P.C.

(57) ABSTRACT

A variable path infant walker having a tunnel assembly of intersecting paths. A ball assembly is arranged within the tunnel assembly and moves along any of the intersecting paths. Posts support the tunnel assembly a spaced distance above the ground. An infant seat is joined to the ball assembly by a cable which extends through an elongated slot in the bottom half of the tunnel assembly to enable an infant in the infant seat to move along an infant selected variable path.

7 Claims, 5 Drawing Sheets

FIG. 2
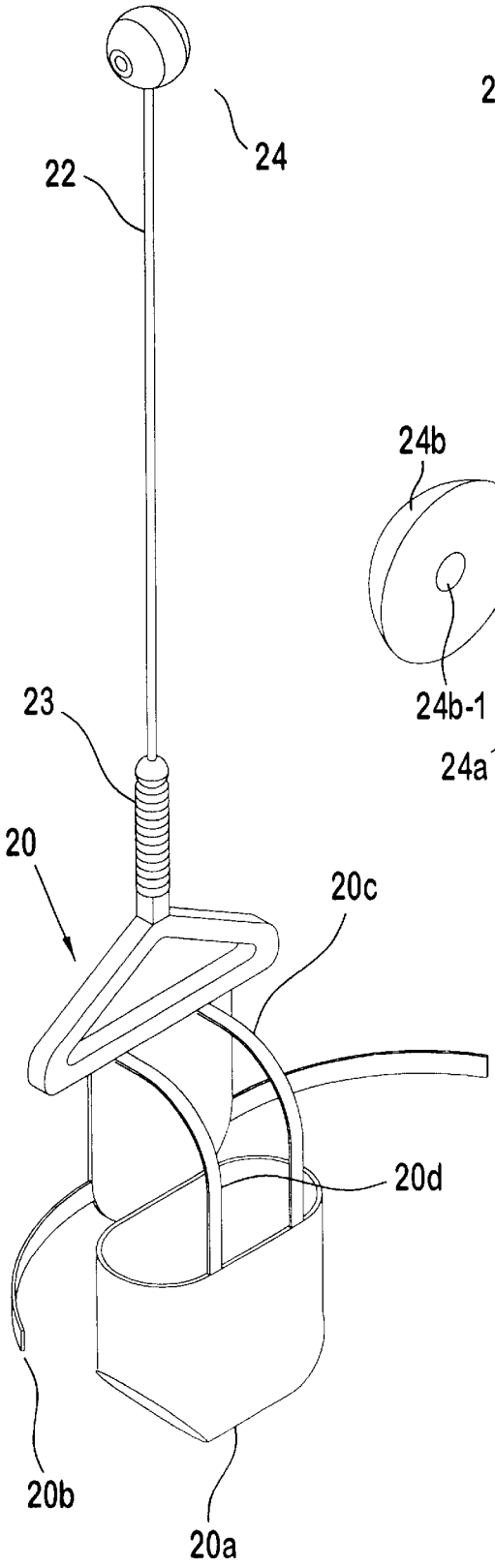
FIG. 3c
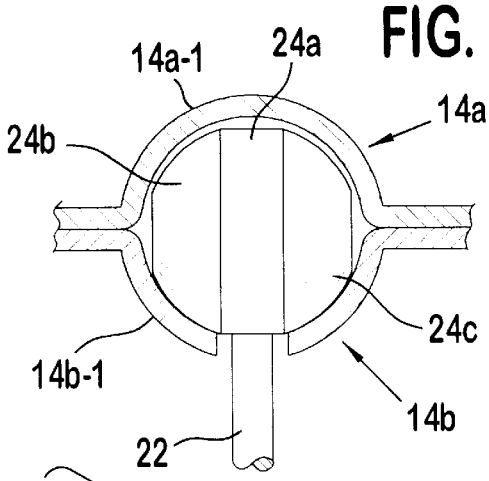
FIG. 3d
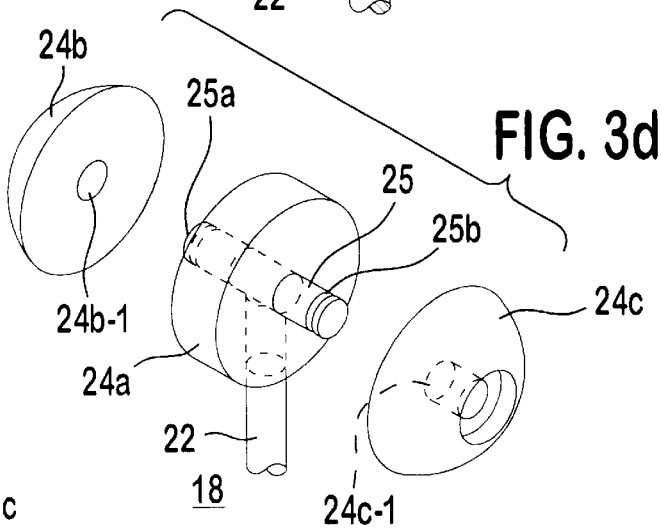
FIG. 3e
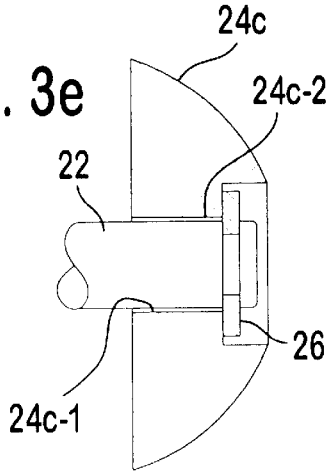
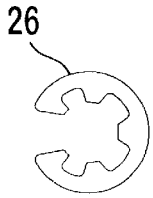
FIG. 3f

VARIABLE PATH INFANT WALKER

BACKGROUND

The present invention relates to walkers for infants and more particularly to a novel walker having a child selectable variable path which enhances interest and use thereof.

SUMMARY

Infant walkers presently available in the marketplace assume a variety of configurations. One typical device is a wheeled device which provides some, but not total, support for an infant learning to walk. In addition, since the device is wheeled, there is a significant danger that the infant may accidently direct the walker over a ledge, step or other dangerous region. In addition, the wheeled walkers lack stability and the child can easily fall over, even during what may be considered a normal use.

Another type of walker is one which the device is supported from overhead being fixed to a stationary support such as a cross-piece of a door frame. These devices, although preventing the child from tipping over and falling out, have no capability of any significant linear movement along a supporting surface and are used more for bouncing then walking.

Still other devices presently in the marketplace have a capability of providing a support which is movable along an overhead rail along a fixed linear path. While giving the infant latitude of movement along a supporting surface, the path does not vary and the device quickly leads to boredom.

The present invention is characterized by comprising apparatus for encouraging a child to walk and explore by providing a supporting seat suspended by an overhead structure which enables the infant to personally and independently select a variable path along which the infant may walk thus greatly increasing the interest of the infant in the use of the apparatus.

The infant is supported in a seat which, in turn, is suspended by a cable or other like member having a roller structure at its upper end which rides within a group of interconnected tunnels, enabling the child to move from one transverse path to another. As an alternative design, the tunnels may be shaped to cause the infant to move from one transverse path to another.

It is therefore one objective of the present invention is to provide a novel infant walker enabling the user to vary the path of movement.

Still another object of the present invention is to provide a novel tunnel structure for use in infant walkers and the like which enable the infant to vary the path along which the infant moves.

BRIEF DESCRIPTION OF THE DRAWINGS

The above as well as other objects of the present invention will become apparent when reading the accompanying description and drawings in which:

FIG. 2 is a detailed view of the walker's seat structure, incorporated in the infant walker of FIG. 1.

FIG. 3*c* is a sectional view of the tunnel assembly looking in the direction of arrows 3C—3C in FIG. 3*b*.

FIG. 3*d* is an exploded perspective view of the ball structure of FIG. 3*c*.

FIG. 3*e* is a partially sectionalized exploded view of a portion of the ball structure of FIGS. 3*c* and 3*d*.

FIG. 3*f* is a plan view of the locking c-clip employed in the assembly of FIG. 3*e*.

DETAILED DESCRIPTION OF THE INVENTION AND PREFERRED EMBODIMENTS THEREOF

Figure 1:
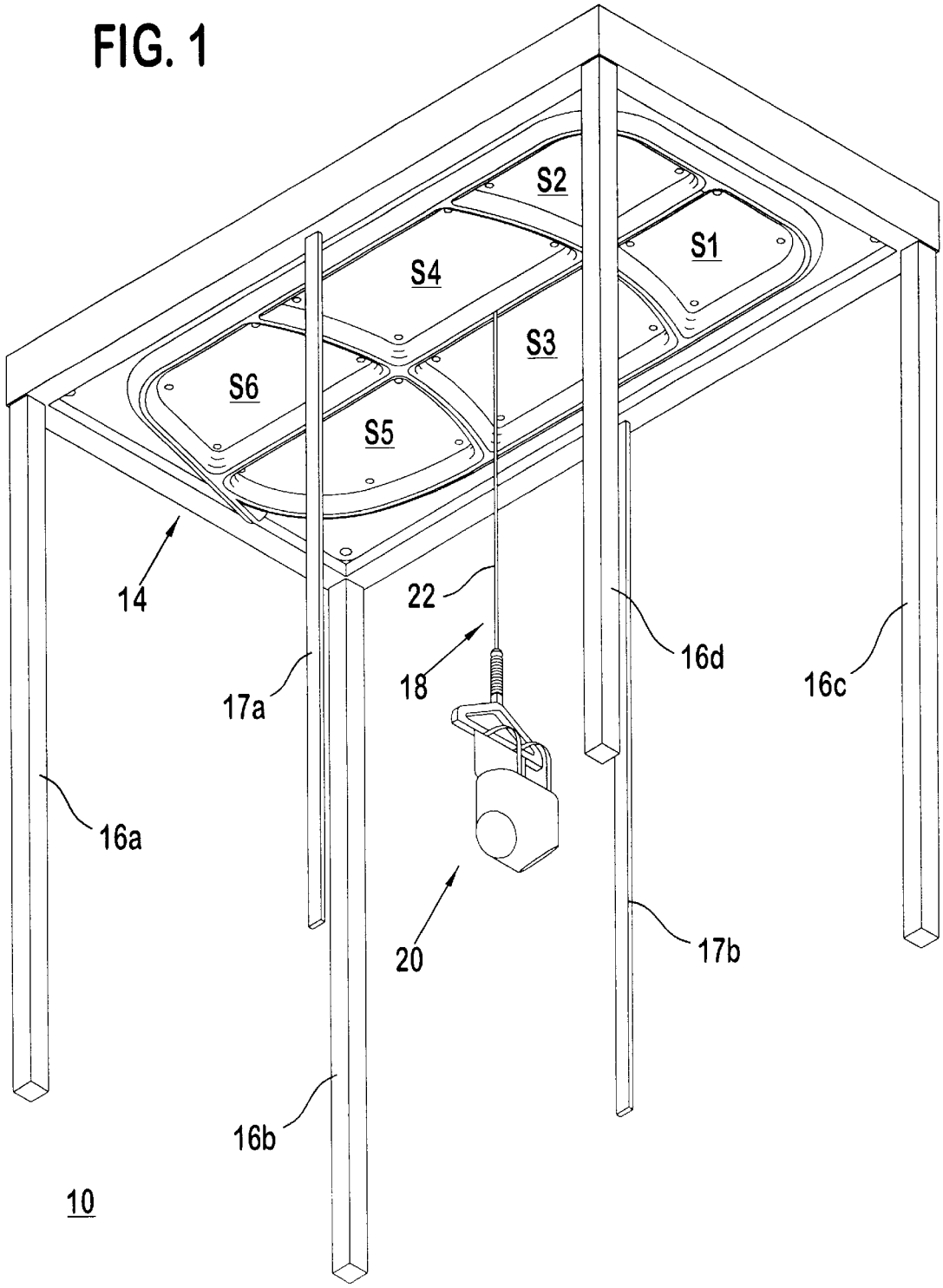
FIG. 1 is a perspective view of the infant walker of the present invention.

FIG. 1 shows an infant walker 10 embodying the principles of the present invention and comprising a support frame 12 for supporting a tunnel assembly 14. Support frame 12 is supported above the ground or any other suitable support surface by support posts 16*a*, 16*b*, 16*c* and 16*d*.

Figure 3A:
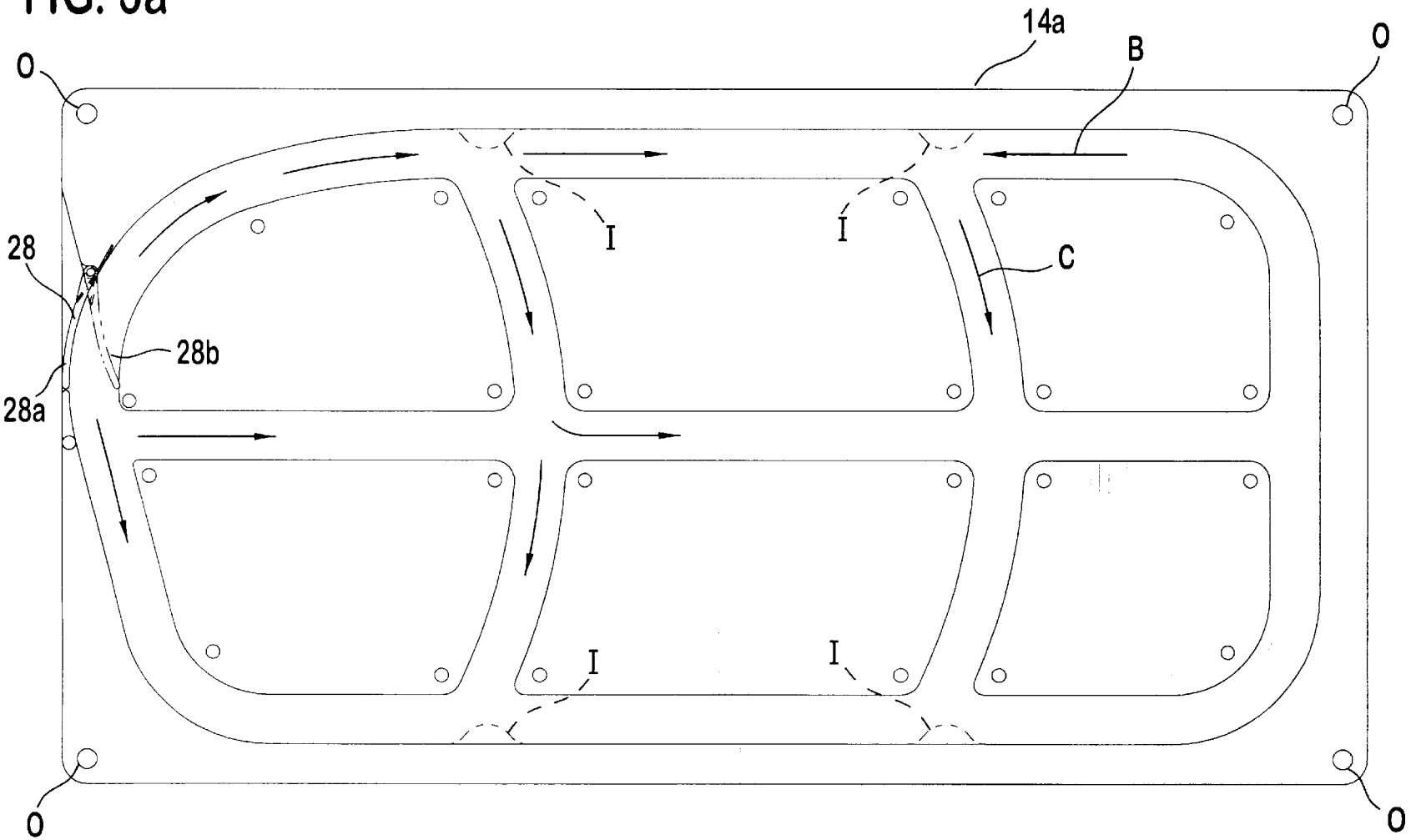
FIGS. 3*a* and 3*b* show plan views of the top and bottom members of the tunnel structure employed in the present invention as shown in FIG. 1.
Figure 3B:
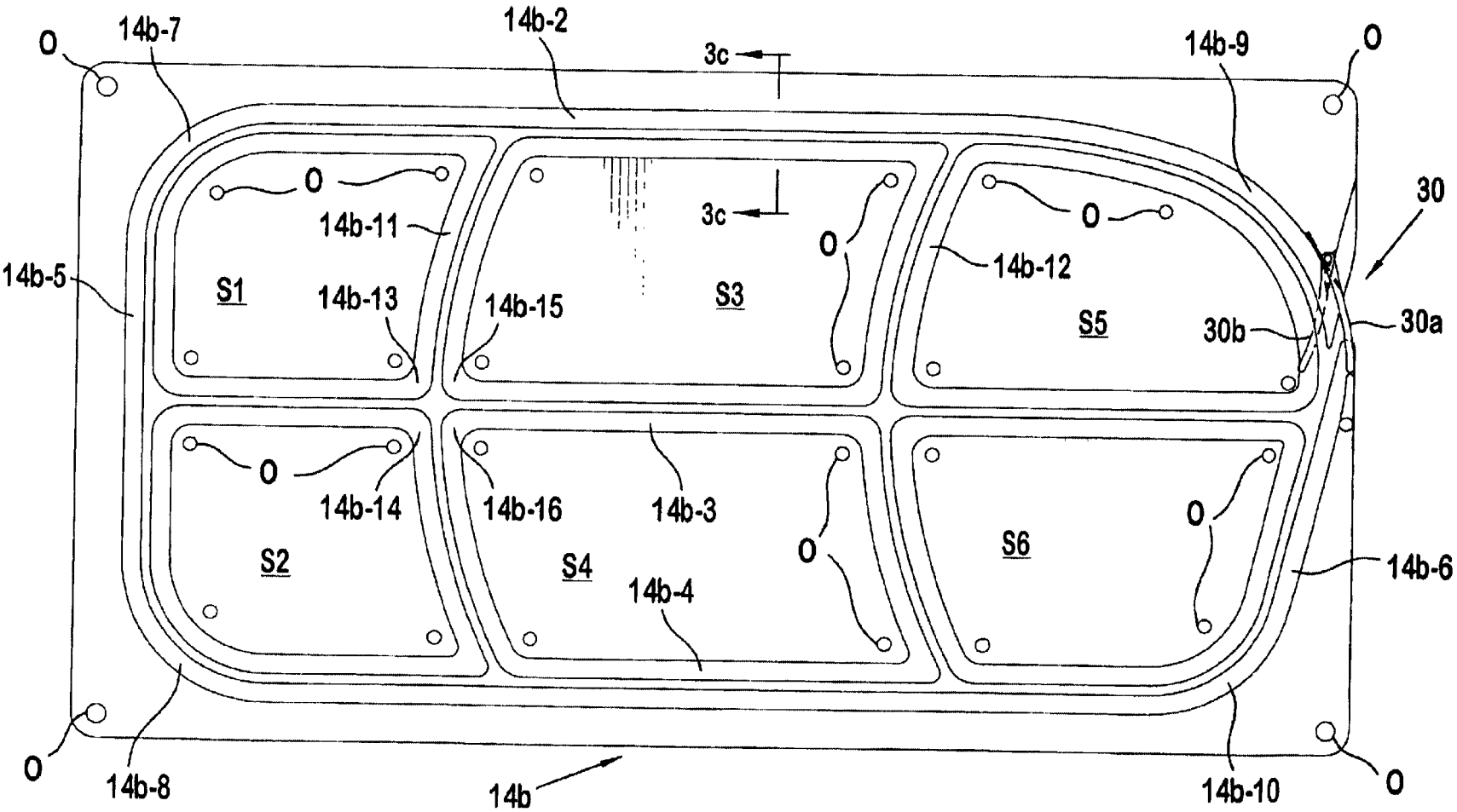
Figure 4:
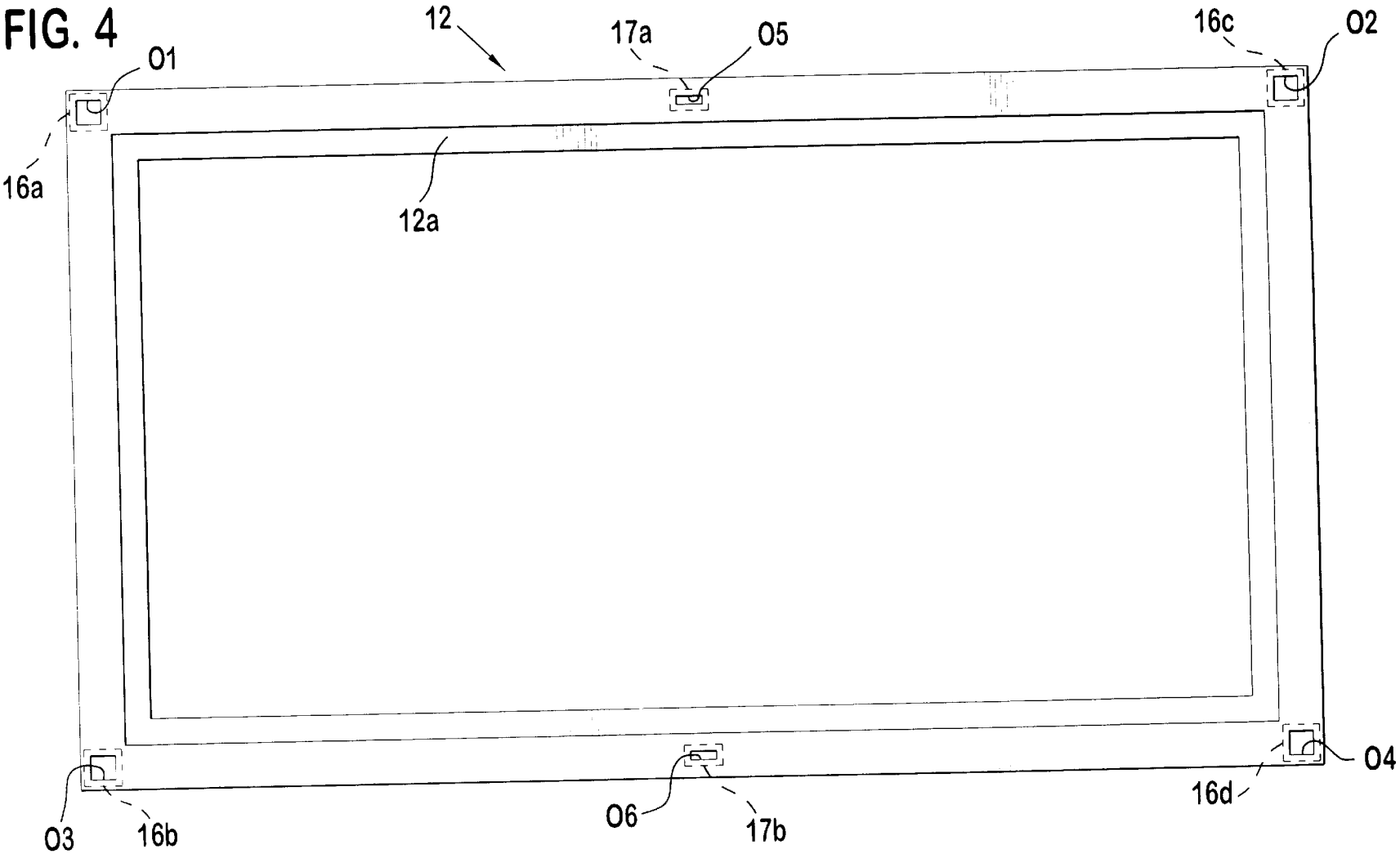
FIG. 4 shows the top support member for supporting the tunnel structures of FIGS. 3*a* and 3*b*.

The tunnel assembly 14 is shown in detail in FIGS. 3*a*, 3*b* and 3*c* and 3*d*. FIG. 3*a* shows the top half 14*a* of tunnel assembly 14 while FIG. 3*b* shows the bottom half of the tunnel structure 14*b*. FIG. 3*c* shows a sectional view looking in the direction of arrows 3*c*—3*c* in FIGS. 3*a* and 3*b*. The top and bottom members 14*a* 14*b* may be formed of a suitable metallic material. The tunnel structure is defined by providing the top member 14*a* with a substantially semi-circular-shaped portion 14*a*-1. A similar semi-circular-shaped portion 14*b*-1 is formed in bottom member 14*b*, however, the bottom member 14*b* is provided with a cut-away opening. When the top and bottom members 14*a* and 14*b* are brought together, they form a substantially circular-shaped "tunnel" for receiving the ball assembly 24 provided at the upper end of a cable member 22, the lower end of which is joined to the upper end of an infant seat 21, all of the aforesaid components forming the infant seat assembly 18. FIGS. 3*c*, 3*d* and 3*e* show the ball assembly 24 as comprised of a central portion 24*a* having an opening for receiving a rod 25, fixedly secured to central number 24*a* and extending outwardly in both the leftward and rightward directions and being provided with an annular groove 25*a* and 25*b* at opposite ends of rod 25. The upper end of cable 18 extends through an opening in ball member 24*a* and is secured to rod 25 in any suitable fashion.

Members 24*b* and 24*c*, forming part of the ball assembly are each provided with central openings 24*b*-1, 24*c*-1 for receiving opposing ends of rod 25. FIG. 3*a* shows the detailed manner in which rotatable and members 24*b* and 24*c* are fixed to rod 25. The opening 24*c*-1 in member 24*c* is of increased diameter at the curved end thereof thereby forming a ledge 24*c*-2. A resilient C-clip 26, shown in FIGS. 3*e* and 3*f*, is snap-fitted into groove 25*b* of rod 25, holding member 24*c* on rod 25 while enabling member 24*c* to be freewheeingly rotated about rod 25. Member 24*b* is fastened to the left-hand end of rod 25 in a similar manner and a similar resilient C-clip (not shown) is snap-fittingly received within annular groove 25*a* and rests against a shoulder in member 24*b*, not shown but similar to the shoulder 24*c*-2 and number 24*c*. The members 24*b* and 24*c* are thus able to rotate along one of the paths in the tunnel structure as the infant moves along the surface (or ground) supporting the infant walker.

As shown in FIGS. 3*a* and 3*b*, three substantially elongated walking paths 14*b*-2, 14*b*-3 and 14*b*-4 are provided.

End path 14*b*-5 is joined to paths 14*b*-2 and 14*b*-4 by smoothly curved portions 14*b*-7 and 14*b*-8; end path 14*b*-6 is joined to paths 14*b*-2 and 14*b*-4 by curved sections 14*b*-9 and 14*b*-10. Shorter intermediate paths 14*b*-11 and 14*b*-12 intersect with paths 14*b*-2, 14*b*-3 and 14*b*-4, as shown. The paths of each of the intersections are provided with smoothly curved corners, such as, for example, 14*b*-13 and 14*b*-14, 14*b*-15 and 14*b*-16. All of the other intersections are likewise provided with smoothly rounded curved portions, as shown. It should be understood that the top half of the tunnel structure has cooperating paths 14*c*-2 through 14*c*-12 of a similar design, the only difference between the top and bottom halves of the tunnel structure being that the bottom half is provided with an elongated opening in the rounded portions 14*b*-1, while the rounded portions 14*a*-1 in the top member are fully enclosed.

In order to assemble this structure, the tunnel member 14*b* is provided with openings, at least in the four corners of the "frame" section 5 and the internal sections S-S6 and top section 14*a* is provided with cooperating openings, for receiving suitable fastening members to secure the bottom sections S-S6 to the top section 14*a*. Each of the top and bottom halves are provided with a flexible springlike member 28 provided in the top half member 14*a* and 30 provided in bottom half member 14*b*. The springlike members each have one end 28*a*, 30*a* fixedly secured to their associated tunnel member and having a leaf-like member 28*b*, 30*b* which is normally biased in the direction shown by arrows A1, A2. The ball assembly 24 is pressed into the fittings provided in cooperating tunnel members 14*a*, 14*b*. Once the ball has passed the self-locking members 28, 30, these members snap back into the position, each resting within an associated recess R1, R2 provided in each of the tunnel members so as to position the self-locking members in such a manner so that they do not interfere with the movement of the ball in either direction past the self-locking members.

When sections S-S6 comprising the bottom half of the tunnel assembly are joined to the top half 14*a* by suitable fastening means, the tunnel assembly is placed upon a ledge 12*a* on which the tunnel assembly rests. Support 12 is provided with openings O1 through O4 for receiving the upper ends of support members 16*a* through 16*b* respectively. The openings, O1 through O4 are slightly reduced in size relative to the cross-section of the major portion of the legs 16*a* through 16*b*, the upper ends thereof being of reduced size to fit within the openings O1 through O4 and the meeting point between the portions of reduced size supporting the support member 12 upon the legs 16*a* through 16*d*. Two additional supports 17*a*, 17*b* are provided intermediate the length of the long sides of support 12 and are inserted through openings O5 and O6 to provide additional support. The members 17*a* and 17*b* are of reduced size at their ends in order to be received within the openings O5 and O6 and to provide ledges L1 for supporting the support frame 12.

The present invention may be sold in a "knocked-down" fashion and be easily and quickly assembled at a point of use.

If, for any reason, it is necessary to remove the ball assembly, members 28, 30 may be pushed inwardly by an amount sufficient to move the ball assembly 24 behind the flexing portions 28*b* and 30*b*.

The infant seat 20 has a portion 20*a* through which the child's legs extend and is preferably provided with a safety belt 20B for placement around the child's waist and a pair of harness belts 20*c*, 20*d* for placement around the child's shoulders. Cable 22 is coupled to the upper end of the seat assembly 20 by a swivel assembly 23, enabling the child to face in any direction. The cable 22 is made adjustable in length to accommodate infants of different heights to be assured that the infant can walk along the supporting surface.

The tunnel paths are preferably rounded and are smooth, enabling smooth, free movement of the ball assembly 24 therein. If desired, a suitable lubricant such as either a natural or synthetic oil or grease may be placed along the paths to facilitate free, easy movement of the ball assembly.

As an alternative arrangement, the intersections of the paths making up the tunnel network may be modified to provide indentations such as the indentations I, for example, in FIG. 3*a* so that, the roller moving, for example, in the direction of arrow V is caused to move in the direction shown by arrow C due to the presence of the indentation I, thereby providing a means which causes the ball structure to enter into a transverse path.

What is claimed is:

1. A self-supporting infant walker apparatus comprising a ball assembly:

a tunnel assembly having a plurality of intersectioning paths, said tunnel assembly paths having a substantially circular shaped cross-section for receiving said ball assembly;

an undersurface of the tunnel assembly having a continuous slot, a cable coupled to said ball assembly and extending downwardly through said continuous slot;

an infant seat coupled to a lower end of said cable;

a support for supporting said tunnel assembly;

a plurality of support legs for supporting the tunnel assembly support an elevated distance above a support surface; and said tunnel assembly having a plurality of intersecting paths enabling said ball assembly to enter into any of said intersecting paths.

2. The apparatus of claim 1 wherein each of the intersecting paths have rounded corners.

3. The apparatus of claim 1 wherein said tunneling assembly is comprised of top and bottom members;

said top member having plurality of semi-circular shaped recesses, each recess intersecting with at least one other recess;

said bottom half having similar semi-circular shaped recesses and arranged to mate with the recesses in said top-half when said top and bottom halves are joined together;

said recesses in said bottom half having said slot for receiving the cable there through.

4. The apparatus of claim 1 wherein said ball assembly is comprised of an intermediate member having a rod extending therethrough, and first and second substantially hemispheric-shaped members each having an opening for receiving a respective one of the ends of said rod;

fastening clips being received in recesses in said hemispheric-shaped members to secure said hemispheric-shaped members to said rod while enabling said hemispheric-shaped members to freely rotate about said rod.

5. The apparatus of claim 4 wherein said fastening means comprises C-clips arranged to be snap-fitted within an annular recess in said rod.

6. The apparatus of claim 1 wherein said tunnel assembly is comprised of a first plurality of spaced parallel elongated paths; a second plurality of spaced parallel elongated paths which are transverse to the first plurality of spaced parallel elongated paths whereby intersections are provided at locations where each of said paths of said first plurality of paths intersect with paths of said second plurality of paths, the corners of said intersections all being rounded to facilitate smooth, easy movement of said ball assembly at an intersection.

7. The apparatus of claim 6 wherein some of said intersections are substantially T-shaped intersections, said paths having indents at said T-shaped intersections to urge the ball assembly to move transversely into an intersecting path when it engages an indentation.

* * * * *